US008332128B2

(12) United States Patent
Kim

(10) Patent No.: US 8,332,128 B2
(45) Date of Patent: Dec. 11, 2012

(54) ENGINE SYSTEM AND SIGNAL PROCESSING METHOD THEREOF

(75) Inventor: Seungbum Kim, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 13/174,165

(22) Filed: Jun. 30, 2011

(65) Prior Publication Data

US 2012/0138032 A1 Jun. 7, 2012

(30) Foreign Application Priority Data

Dec. 6, 2010 (KR) ..... 10-2010-0123613

(51) Int. Cl.
*F02D 41/00* (2006.01)

(52) U.S. Cl. ..... 701/108; 701/110; 123/676; 123/687; 123/568.12

(58) Field of Classification Search ..... 123/672, 123/676, 568.11, 568.12, 568.21, 568.22, 123/679, 687; 60/285–286; 701/108, 110; 73/114.69, 114.74, 114.76
See application file for complete search history.

(56) References Cited

U.S. PATENT DOCUMENTS 6,698,192 B2 * 3/2004 Ootake ..... 60/297
6,945,037 B2 9/2005 Plote et al.
7,159,392 B2 * 1/2007 Kondoh et al. ..... 60/297
7,171,803 B2 * 2/2007 Saito et al. ..... 60/297
7,310,941 B2 * 12/2007 Kuboshima et al. ..... 60/297
7,322,184 B2 * 1/2008 Kondou et al. ..... 60/297
7,658,064 B2 * 2/2010 Konstandopoulos ..... 60/297
8,127,592 B2 * 3/2012 Konstandopoulos ..... 73/28.03
2007/0056264 A1 * 3/2007 Hou et al. ..... 60/274

FOREIGN PATENT DOCUMENTS

EP 1362167 B1 3/2009
JP 2002-256846 9/2002
JP 2008-261301 10/2008
KR 1020050050163 A 5/2005

* cited by examiner

*Primary Examiner* — Hai Huynh
(74) *Attorney, Agent, or Firm* — Morgan, Lewis & Bockius LLP

(57) ABSTRACT

An engine system may include an engine generating torque through a crankshaft, an exhaust line that exhaust gas of the engine flows, a diesel particulate filter disposed on the exhaust line to trap particulate matters of the exhaust gas, a first pressure difference sensor configured to detect a front/rear pressure difference of the diesel particulate filter, a temperature sensor configured to detect a temperature of exhaust gas flowing into the diesel particulate filter, and a control unit that detects signal form the temperature sensor and the first pressure difference sensor in a predetermined rotation cycle of the crankshaft, uses the detected signal to calculate a front/rear pressure difference of the diesel particulate filter, and calculates a temperature of exhaust gas flowing into the diesel particulate filter. A corresponding signal processing method is also described.

14 Claims, 4 Drawing Sheets

FIG.2

| order | first cylinder | second cylinder | third cylinder | fourth cylinder |
|---|---|---|---|---|
| 1 | explosion | exhaust | intake | compression |
| 2 | exhaust | intake | compression | explosion |
| 3 | intake | compression | explosion | exhaust |
| 4 | compression | explosion | exhaust | intake |

four cylinder engine

ENGINE SYSTEM AND SIGNAL PROCESSING METHOD THEREOF

CROSS-REFERENCE TO RELATED APPLICATION

This application claims priority to and benefit of Korean Patent Application No. 10-2010-0123613 filed Dec. 6, 2010, the entire contents of which application is incorporated herein for all purposes by this reference.

BACKGROUND OF INVENTION

1. Field of Invention

The present invention relates to an engine system that detects a temperature of the exhaust gas flowing an exhaust line and a front/rear pressure difference of a diesel particulate filter or an EGR valve and a signal processing method thereof.

2. Description of Related Art

Generally, a diesel particulate filter is applied to trap particulate matters included in exhaust gas of a diesel engine and a front/rear pressure difference of the diesel particulate filter is used to detect amount of the particulate matters trapped therein.

Further, an EGR line is disposed to circulate exhaust gas from an exhaust line to an intake line, an EGR valve of the EGR line controls a flux of the EGR gas, and a pressure difference between a front and a rear of the EGR valve is detected to calculate the flux of the EGR gas.

Meanwhile, since the engine performs an intake, a compression, an explosion, and an exhaust strokes, a temperature of the exhaust gas passing the exhaust line and a pressure of the exhaust gas are varied periodically and it is difficult to detect a temperature of the exhaust gas and a front/rear pressure difference of the diesel particulate filter or the EGR valve.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide an engine system and a signal processing method thereof having advantages of precisely measuring a temperature of exhaust gas and a pressure difference between a front and a rear of a diesel particulate filter or an EGR valve by using a temperature/pressure difference that is detected according to an intake, a compression, an explosion, and an exhaust stroke of an engine.

One aspect of the present invention is directed to an engine system that may include an engine that generates torque through a crankshaft, an exhaust line that exhaust gas of the engine flows, a diesel particulate filter that is disposed on the exhaust line to trap particulate matters of the exhaust gas, a first pressure difference sensor that is configured to detect a front/rear pressure difference of the diesel particulate filter, a temperature sensor that is configured to detect a temperature of exhaust gas flowing into the diesel particulate filter, and a control unit that detects signal form the temperature sensor and the first pressure difference sensor in a predetermined rotation cycle of the crankshaft, uses the detected signal to calculate a front/rear pressure difference of the diesel particulate filter, and calculates a temperature of exhaust gas flowing into the diesel particulate filter.

The control unit may detect a first pressure difference signal transferred from the first pressure difference sensor at a rotation position of the crankshaft that corresponds to an exhaust stroke of the engine, detect a second pressure difference signal transferred from the first pressure difference sensor at a rotation position of the crankshaft between neighboring exhaust strokes, and average the first pressure difference signal and the second pressure difference signal to calculate the front/rear pressure difference of the diesel particulate filter.

The control unit may detect a first temperature signal transferred from the temperature sensor at a rotation position of the crankshaft corresponding to an exhaust stroke of the engine, detect a second temperature signal transferred from the temperature sensor at a rotation position of the crankshaft between neighboring exhaust strokes, and average the first temperature signal and the second temperature signal to calculate a temperature of the exhaust gas.

The engine may be four cylinders type and perform four stroke cycles such as intake, compression, explosion, and exhaust, and the control unit may receive signals from the first pressure difference sensor every time the crankshaft rotates 90 degrees from the exhaust stroke of the engine and averages the received signals to calculated a front/rear pressure difference of the diesel particulate filter.

The engine may be four cylinders type and perform four stroke cycles such as intake, compression, explosion, and exhaust, and the control unit may receive signals from the temperature sensor every time the crankshaft rotates 90 degrees from the exhaust stroke of the engine and averages the received signals to calculated a temperature of exhaust gas.

The engine system may include an intake line that air flows to the engine, an EGR line that exhaust gas is recirculated from the exhaust line to the intake line, an EGR cooler that is disposed on the EGR line to cool the recirculated exhaust gas, an EGR valve that is disposed at an upstream side of the EGR cooler to control the flux of the recirculated exhaust gas, and a second pressure difference sensor that detects pressure difference between a front portion of the EGR valve and a rear portion of the EGR cooler, wherein the control unit detects signal from the second pressure difference sensor in a cycle of a predetermined rotation angle of the crankshaft and uses the detected signal to calculated a flux of the EGR gas flowing the EGR line.

The control unit may detect a third pressure difference signal transferred from a second pressure difference sensor at a rotation position of the crankshaft corresponding to an exhaust stoke of the engine, detect a fourth pressure difference signal transferred from a second pressure difference sensor at a rotation position of the crankshaft between neighboring exhaust strokes, and average the third pressure difference signal and the fourth pressure difference signal to calculate a flux of the EGR gas flowing the EGR line.

A signal processing method of an engine system may include detecting a rotation angle of a crankshaft, detecting a temperature of exhaust gas from a temperature sensor in a cycle of a predetermined rotation angle of the crankshaft, detecting a front/rear pressure difference of a diesel particulate filter in a cycle of the predetermined rotation angle, calculating a temperature of the exhaust gas by averaging the detected temperature signals that is detected in a cycle, and calculating a front/rear pressure difference of the diesel particulate filter by averaging the pressure difference signal that is detected in a cycle.

The signal processing method may include detecting a first pressure difference signal transferred from the first pressure difference sensor at a rotation position of the crankshaft corresponding to an exhaust stroke, detecting a second pressure difference signal transferred from the first pressure difference sensor at a rotation position of the crankshaft between neighboring exhaust stroke, and calculating a front/rear pressure difference of the diesel particulate filter by averaging the first pressure difference signal and the second pressure difference signal.

The signal processing method may include detecting a first temperature signal transferred from the first temperature sensor at a rotation position corresponding to an exhaust stroke, detecting a second temperature signal transferred from the temperature sensor at a rotation position of the crankshaft corresponding to an exhaust stroke, and calculating a temperature of the exhaust gas by averaging the first temperature signal and the second temperature signal.

The engine may be four cylinders type and perform four stroke cycles such as intake, compression, explosion, and exhaust, and the signal is received from the first pressure difference sensor every time the crankshaft rotates 90 degrees from the exhaust stroke of the engine and calculate a front/rear pressure difference of the diesel particulate filter by averaging the received signals.

The engine may be four cylinders type and perform four stroke cycles such as intake, compression, explosion, and exhaust, and signals are received from the temperature sensor every time the crankshaft rotates 90 degrees from the exhaust stroke of the engine and calculate a temperature of the exhaust gas filter by averaging the received signals.

The signal processing method may include detecting signal from the second pressure difference sensor in a cycle of a predetermined rotation angle of the crankshaft, and calculating a flux of the EGR gas flowing the EGR line by using the detected signals.

The signal processing method may include detecting a third pressure difference signal transferred from the second pressure difference sensor at a rotation position of the crankshaft corresponding to an exhaust stroke of the engine, detecting a fourth pressure difference signal transferred from the second pressure difference sensor at a rotation position of the crankshaft between neighboring exhaust strokes, and averaging the third pressure difference signal and the fourth pressure difference signal to calculating a flux of the EGR gas flowing the EGR line.

In the engine system according to the present invention as described above, a temperature signal and a pressure difference signal of the exhaust gas are detected between neighboring exhaust strokes and the exhaust gas temperature and the pressure difference are accurately calculated thereby. Further, signals for the exhaust gas temperature and signals for the pressure difference are detected corresponding to strokes of the engine in a cycle of a predetermined rotation angle of the crankshaft, and therefore the exhaust gas temperature and the pressure difference are accurately calculated.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 2 is a table showing a stroke of an engine in an exemplary engine system according to the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
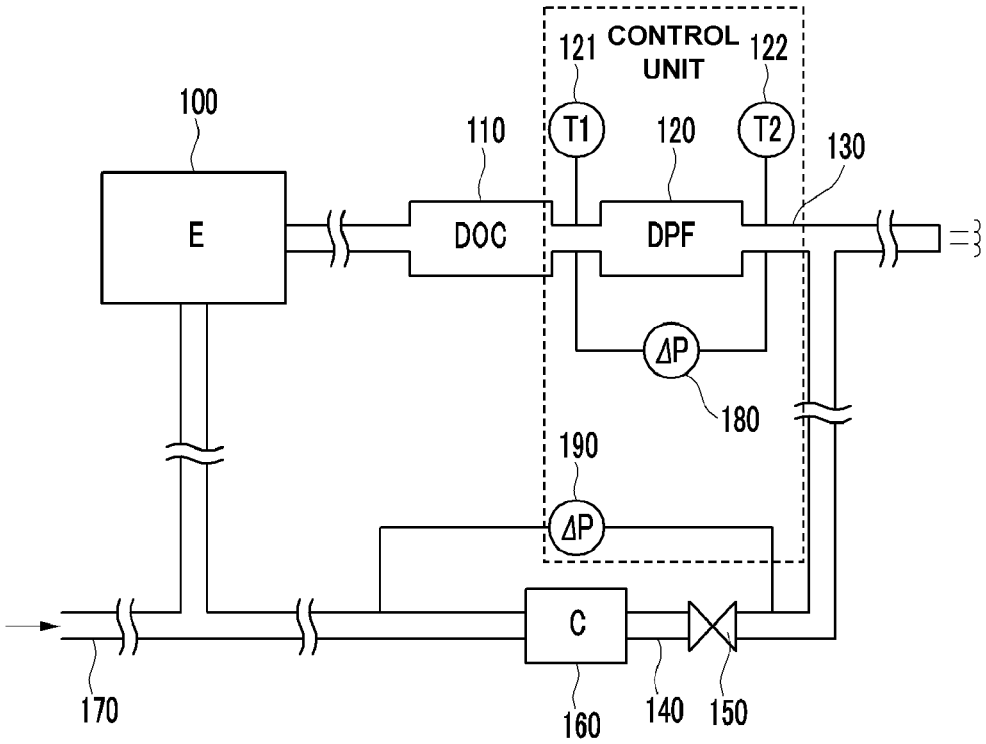
FIG. 1 is a schematic diagram of an exemplary engine system according to the present invention.

Referring to FIG. 1, an engine system includes an engine 100, an exhaust line 130, a diesel oxidation catalyst 110, a diesel particulate filter 120, a first temperature sensor 121, a second temperature sensor 122, a first pressure difference sensor 180, an EGR line 140, an EGR valve 150, an EGR cooler 160, a second pressure difference sensor 190, and an intake line 170.

The engine 100 generates exhaust gas and the exhaust gas is exhausted to the outside through the exhaust line 130. Here, the exhaust gas is released to the atmosphere through the diesel oxidation catalyst 110 and the diesel particulate filter 120.

The EGR line 140 is diverged from a downstream side of the diesel particulate filter 120 in the exhaust line 130 to be connected to the intake line 170.

One part of the exhaust gas flowing the exhaust line 130 is emitted into the atmosphere and the other part joins the intake line 170 through the EGR line 140.

The first and second temperature sensors 121 and 122 detect temperature of exhaust gas flowing the exhaust line 130 and transfer the detected signal to the control unit, and the first pressure difference sensor 180 detects a front/rear pressure difference of the diesel particulate filter 120 and transfer the detected signal to the control unit.

The EGR valve 150 and the EGR cooler 160 are sequentially disposed on the EGR line 140 in a direction that EGR gas flows, and the second pressure difference sensor 190 detects a front/rear pressure difference of the EGR valve 150 and transfers the detected signal to the control unit.

The control unit uses a pressure difference signal transferred from the second pressure difference sensor 190 to calculate a flux of EGR gas flowing through the EGR valve 150 of the EGR line 140. Further, opening rate of the EGR valve 150 is controlled based on the flux of the EGR gas calculated.

The engine 100 performs an intake, a compression, an explosion, and an exhaust stroke. In various embodiments of the present invention, and the temperature and the pressure of the exhaust gas flowing the exhaust line 130 and the EGR line 140 are varied thereby. For example, the pressure of the exhaust gas is high at the exhaust stroke and is low at the intake stroke. The exhaust gas temperature is varied according to a stroke of the engine.

Further, a stroke of the engine 100 is performed periodically and the stroke of the engine 100 is closely connected with a rotation angle of the crankshaft that outputs a toque of the engine 100. Accordingly, the exhaust gas temperature or the exhaust gas pressure difference is detected according to a stroke of the engine 100 or a rotation angle of the crankshaft in various embodiments of the present invention to improve precision thereof.

Referring to FIG. 2, four cylinders four strokes engine has a first, a second, a third, and a fourth cylinder, and the cylinders repeat an explosion, an exhaust, an intake, and a compression strokes sequentially. Further, the exhaust stroke is performed in a cycle of 180 degrees centering around the crankshaft. Accordingly, since the exhaust gas flux is high at the exhaust stroke and the exhaust gas flux is low between the exhaust strokes, the first pressure difference sensor 180, the second pressure difference sensor 190, and the first and second temperature sensors 121 and 122 detect signal in a cycle of 90 degrees centering around the crankshaft.

Since, the explosion stroke is performed in a cycle of 125 degrees in a six cylinder engine and the explosion stroke is performed in a cycle of 90 degrees in a eight cylinder engine in other embodiments of this invention, the signal is detected in a cycle of 67.5 degrees in the six cylinder engine and the signal is detected in a cycle of 45 degrees in the eight cylinder engine.

Figure 3:
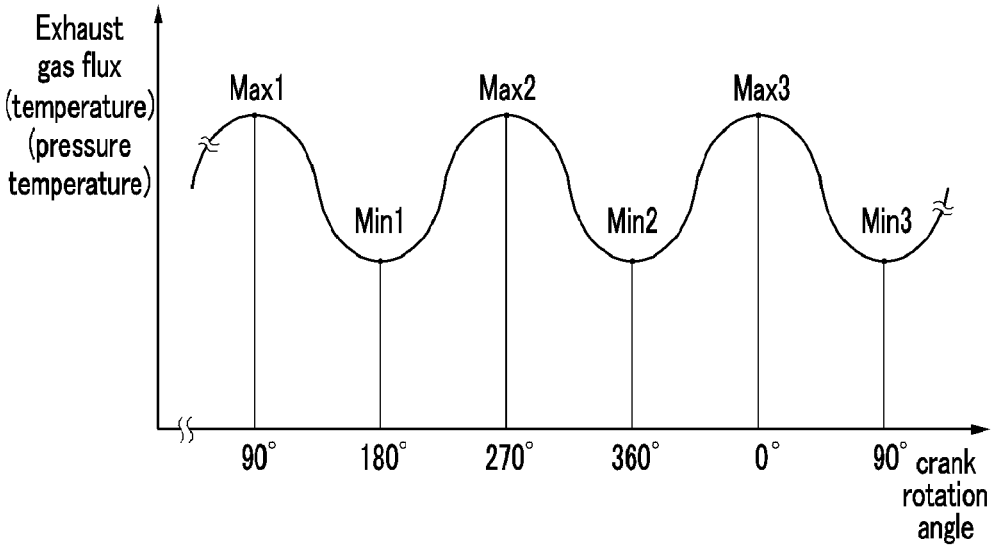
FIG. 3 is a graph showing a relation between a crank angle and exhaust gas flux in an exemplary engine system according to the present invention.

Referring to FIG. 3, a horizontal axis shows a rotation angle of the crankshaft of four cylinder engine and a vertical axis shows exhaust gas flux (pressure).

For example, Max1 value is outputted at a rotation position of 90 degrees in an aspect of the exhaust gas flux and Min1 value is outputted at a rotation position of 180 degrees thereof. Continuously, Max2, Min2, Max3, and Min3 are outputted. Here, 0 point of the crankshaft can be varied according to a design specification.

The exhaust gas flux is varied in a predetermined cycle. A pressure difference that is detected by the first pressure difference sensor 180, a pressure difference that is detected by the second pressure difference sensor 190, and a temperature that is detected by the first and second temperature sensors 121 and 122 are varied with a predetermined cycle according to the exhaust gas flux in various embodiments of the present invention.

Figure 4:
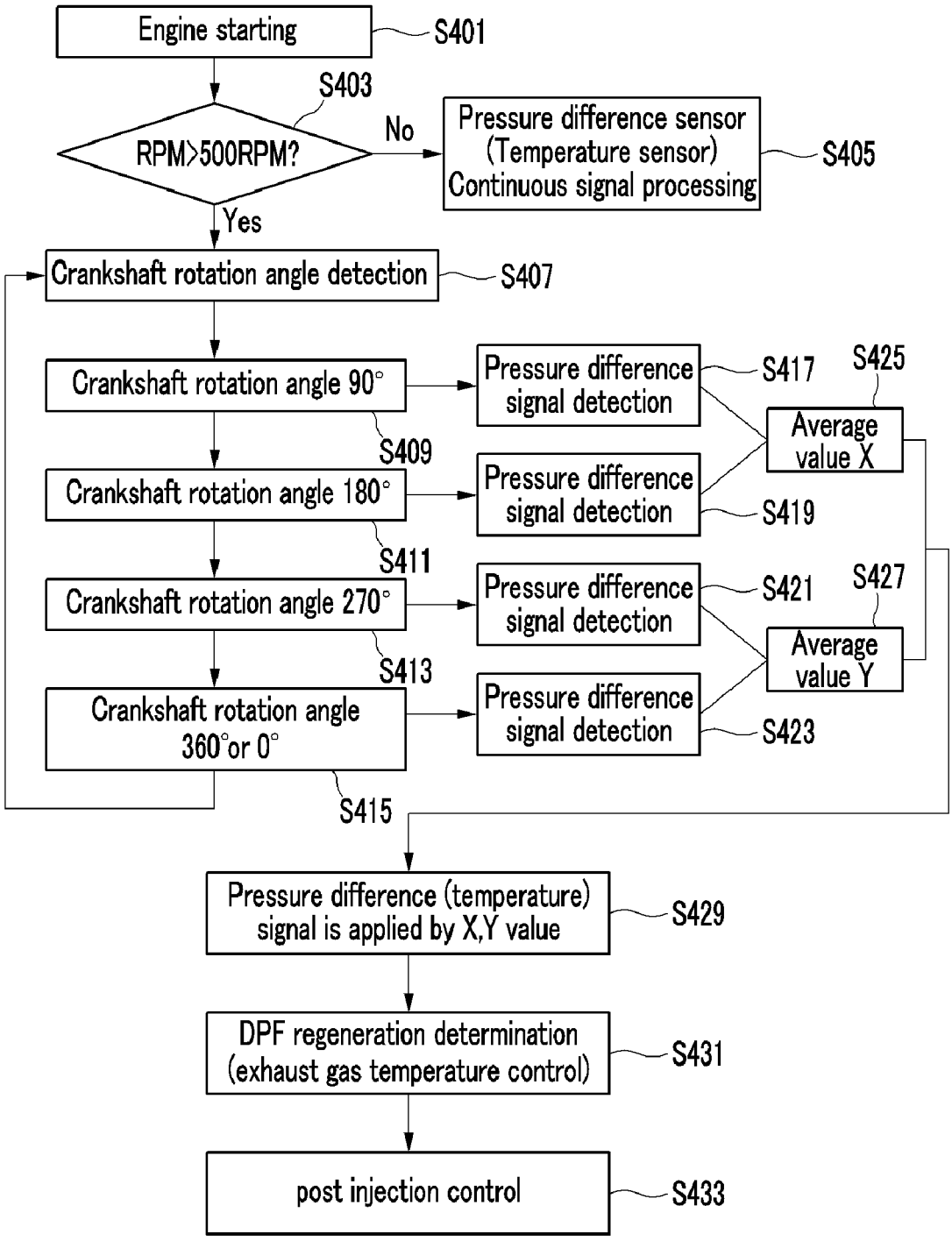
FIG. 4 is a flowchart for controlling an exemplary engine system according to the present invention.

Referring to FIG. 4, an engine 100 is operated in a S401 and the control thereof starts.

is determined whether a rotation speed of the engine 100 exceeds 500 RPM in a S403, if the rotation speed of the engine 100 does not exceed 500 RPM, the signals that are transferred from the first and second pressure difference sensors 180 and 190 and the first and second temperature sensors 121 and 122 are continuously processed. The method for continuously processing the signal is the same as that of the conventional method.

A rotation angle of the crankshaft is detected in a S407, it is detected whether the crankshaft rotates 90 degrees in a S409, it is detected whether the crankshaft rotates 180 degrees in a S411, it is detected whether the crankshaft rotates 270 degrees in a S413, and it is detected whether the crankshaft rotates 360 degrees in a S415.

Corresponding to the S409, the S411, the S413, and the S415, a first pressure difference signal is transferred from the first pressure difference sensor 180 in a S417 and the second pressure difference signal is transferred from the first pressure difference sensor 180 in a S419. The pressure difference signal is received in the same way in the S421 and S423.

The first and second pressure difference signals are averaged to calculate X value in a S425 and the pressure difference signals are averaged to calculate Y value in a S427.

The X and Y values are used as a real pressure difference signal in a S429, and the trapping amount of the PM is calculated and it is determined whether the diesel particulate filter 120 is to be regenerated or not thereby in a S431. Further, a post injection is controlled to regenerate the diesel particulate filter 120 in a S433.

In the FIG. 4, the first and second pressure difference signals are detected from the first pressure difference sensor according to a rotation angle of the crankshaft and the detected values are averaged.

In the same way, the third and fourth pressure difference signals are detected from the second pressure difference sensor 190 that is disposed on the EGR line 140 and the detected values are averaged so as to accurately predict and control the EGR gas flux flowing the EGR line 140.

Further, in the same way, the first and second temperature signals are detected from the first and second temperature sensors 121 and 122 and the detected values are averaged such that the exhaust gas temperature of the exhaust line 130 is accurately detected and controlled.

According to various embodiments of the present invention, an EGR (exhaust gas recirculation) system is operated in a low pressure, and the system is provided with an EGR valve that direct controls a pressure of the EGR gas and is used to calculate the pressure of the EGR gas and the flux thereof.

For convenience in explanation and accurate definition in the appended claims, the terms front or rear, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine system, comprising an engine that generates torque through a crankshaft;

an exhaust line through which engine exhaust gas flows;

a diesel particulate filter disposed in the exhaust line to trap particulate matters of the exhaust gas;

a first pressure difference sensor configured to detect a front/rear pressure difference of the diesel particulate filter;

a temperature sensor configured to detect a temperature of exhaust gas flowing into the diesel particulate filter; and a control unit that detects singles from the temperature sensor and the first pressure difference sensor in a predetermined rotation cycle of the crankshat;

wherein the control unit averages the detected singles when a rotation speed of the engine is higher than a predetermined value to determine a front/rear pressure difference of the diesel particulate filter, and to determine a temperature of exhaust gas flowing into the diesel particulate filter.

2. The engine system of claim 1, wherein the control unit detects a first pressure difference signal transferred from the first pressure difference sensor at a rotation position of the crankshaft that corresponds to an exhaust stroke of the engine, detects a second pressure difference signal transferred from the first pressure difference sensor at a rotation position of the crankshaft between neighboring exhaust strokes, and averages the first pressure difference signal and the second pressure difference signal to determine the front/rear pressure difference of the diesel particulate filter.

3. The engine system of claim 2, wherein the control unit detects a first temperature signal transferred from the temperature sensor at a rotation position of the crankshaft corresponding to an exhaust stroke of the engine, detects a second temperature signal transferred from the temperature sensor at a rotation position of the crankshaft between neighboring exhaust strokes, and averages the first temperature signal and the second temperature signal to determine a temperature of the exhaust gas.

4. The engine system of claim 2, wherein the engine is four cylinders type and performs four stroke cycles having intake, compression, explosion, and exhaust, and the control unit receives signals from the first pressure difference sensor every time the crankshaft rotates 90 degrees from the exhaust stroke of the engine and averages the received signals to determine a front/rear pressure difference of the diesel particulate filter.

5. The engine system of claim 3, wherein the engine is four cylinders type and performs four stroke cycles having intake, compression, explosion, and exhaust, and the control unit receives signals from the temperature sensor every time the crankshaft rotates 90 degrees from the exhaust stroke of the engine and averages the received signals to determine a temperature of exhaust gas.

6. The engine system of claim 1, comprising:

an intake line that air flows to the engine;

an EGR line that exhaust gas is recirculated from the exhaust line to the intake line;

an EGR cooler disposed on the EGR line to cool the recirculated exhaust gas;

an EGR valve disposed at an upstream side of the EGR cooler to control the flux of the recirculated exhaust gas; and a second pressure difference sensor that detects pressure difference between a front portion of the EGR valve and a rear portion of the EGR cooler, wherein the control unit detects signals from the second pressure difference sensor in a cycle of a predetermined rotation angle of the crankshaft and uses the detected singles to determine a flux of the EGR gas flowing the EGR line.

7. The engine system of claim 6, wherein the control unit detects a third pressure difference signal transferred from a second pressure difference sensor at a rotation position of the crankshaft corresponding to an exhaust stoke of the engine, detects a fourth pressure difference signal transferred from a second pressure difference sensor at a rotation position of the crankshaft between neighboring exhaust strokes, and averages the third pressure difference signal and the fourth pressure difference signal to determine a flux of the EGR gas flowing the EGR line.

8. A signal processing method of an engine system, comprising:

detecting a rotation angle of a crankshaft;

detecting a temperature of exhaust gas from a temperature sensor in a cycle of a predetermined rotation angle of the crankshaft;

detecting a front/rear pressure difference of a diesel particulate filter in a cycle of the predetermined rotation angle;

determining a temperature of the exhaust gas by averaging the detected temperature signals detected in a cycle when a rotation speed of an engine is higher than a predetermined value; and determining a front/rear pressure difference of the diesel particulate filter by averaging the pressure difference signal detected in a cycle when a rotation speed of the engine is higher than a predetermined value.

9. The signal processing method of claim 8, comprising:

detecting a first pressure difference signal transferred from the first pressure difference sensor at a rotation position of the crankshaft corresponding to an exhaust stroke;

detecting a second pressure difference signal transferred from the first pressure difference sensor at a rotation position of the crankshaft between neighboring exhaust stroke; and determining a front/rear pressure difference of the diesel particulate filter by averaging the first pressure difference signal and the second pressure difference signal.

10. The signal processing method of claim 9, wherein the engine is four cylinders type and performs four stroke cycles having intake, compression, explosion, and exhaust, and the signal is received from the first pressure difference sensor every time the crankshaft rotates 90 degrees from the exhaust stroke of the engine and determine a front/rear pressure difference of the diesel particulate filter by averaging the received signals.

11. The signal processing method of claim 8, wherein:

detecting a first temperature signal transferred from the first temperature sensor at a rotation position corresponding to an exhaust stroke;

detecting a second temperature signal transferred from the temperature sensor at a rotation position of the crankshaft corresponding to an exhaust stroke; and determining a temperature of the exhaust gas by averaging the first temperature signal and the second temperature signal.

12. The signal processing method of claim 10, wherein the engine is four cylinders type and performs four stroke cycles having intake, compression, explosion, and exhaust, and signals are received from the temperature sensor every time the crankshaft rotates 90 degrees from the exhaust stroke of the engine and determine a temperature of the exhaust gas filter by averaging the received signals.

13. The signal processing method of claim 8, comprising detecting signal from the second pressure difference sensor in a cycle of a predetermined rotation angle of the crankshaft, and determining a flux of the EGR gas flowing the EGR line by using the detected signals.

14. The signal processing method of claim 8, comprising:

detecting a third pressure difference signal transferred from the second pressure difference sensor at a rotation position of the crankshaft corresponding to an exhaust stroke of the engine;

detecting a fourth pressure difference signal transferred from the second pressure difference sensor at a rotation position of the crankshaft between neighboring exhaust strokes; and averaging the third pressure difference signal and the fourth pressure difference signal to determining a flux of the EGR gas flowing the EGR line.

* * * * *